United States Patent [19]

Butler

[11] 4,344,485

[45] Aug. 17, 1982

[54] METHOD FOR CONTINUOUSLY PRODUCING VISCOUS HYDROCARBONS BY GRAVITY DRAINAGE WHILE INJECTING HEATED FLUIDS

[75] Inventor: Roger M. Butler, Calgary, Canada

[73] Assignee: Exxon Production Research Company, Houston, Tex.

[21] Appl. No.: 162,720

[22] Filed: Jun. 25, 1980

[30] Foreign Application Priority Data

Jul. 10, 1979 [CA] Canada ..... 331464

[51] Int. Cl.[3] ..... E21B 43/24; E21B 43/26

[52] U.S. Cl. ..... 166/271; 166/50; 166/272

[58] Field of Search ..... 166/259, 271, 272, 265, 166/314, 50

[56] References Cited

U.S. PATENT DOCUMENTS

| | | | |
|---|---|---|---|
| 1,422,204 | 7/1922 | Hoover et al. | 166/271 |
| 1,491,138 | 4/1924 | Hixon | 166/272 |
| 2,813,583 | 11/1957 | Marx et al. | 166/271 |
| 2,876,838 | 3/1959 | Williams | 166/271 |
| 3,280,909 | 10/1966 | Closmann et al. | 166/271 X |
| 3,347,313 | 10/1967 | Matthews et al. | 166/272 |
| 3,349,845 | 10/1967 | Holbert et al. | 166/271 X |
| 3,412,794 | 11/1968 | Craighead | 166/272 |
| 3,572,436 | 3/1971 | Riehl | 166/272 X |
| 3,705,625 | 12/1972 | Whitten et al. | 166/272 X |
| 3,847,219 | 11/1974 | Wang et al. | 166/272 X |
| 4,022,279 | 5/1977 | Driver | 166/271 |
| 4,116,275 | 9/1978 | Butler et al. | 166/50 |
| 4,265,310 | 5/1981 | Britton et al. | 166/271 X |

*Primary Examiner*—Stephen J. Novosad
*Assistant Examiner*—George A. Suchfield
*Attorney, Agent, or Firm*—Michael A. Nametz

[57] ABSTRACT

A thermal method is disclosed for recovering normally immobile oil from a tar sand deposit. Two wells are drilled into the deposit, one for injection of heated fluid and one for production of liquids. Thermal communication is established between the wells. The wells are operated such that heated mobilized oil and steam flow without substantially mixing. Oil drains continuously by gravity to the production well where it is recovered.

21 Claims, 8 Drawing Figures

METHOD FOR CONTINUOUSLY PRODUCING VISCOUS HYDROCARBONS BY GRAVITY DRAINAGE WHILE INJECTING HEATED FLUIDS

BACKGROUND OF THE INVENTION

1. Field of the Invention

This invention relates to a process for extracting hydrocarbons from the earth. More particularly, this invention relates to a method for recovering viscous hydrocarbons such as bitumen from a subterranean reservoir by continuously injecting a heated fluid to lower the viscosity of the viscous hydrocarbons concurrent with production of mobilized hydrocarbons.

2. Description of the Prior Art

In many areas of the world, there are large deposits of viscous petroleum, such as the Athabasca and Cold Lake regions in Alberta, Canada, the Jobo region in Venezuela and the Edna and Sisquoc regions in California. These deposits are often referred to as "tar sand" or "heavy oil" deposits due to the high viscosity of the hydrocarbons which they contain. These tar sands may extend for many miles and occur in varying thicknesses of up to more than 300 feet. Although tar sand deposits may lie at or near the earth's surface, generally they are located under a substantial overburden which may be as great as several thousand feet thick. Tar sands located at these depths constitute some of the world's largest presently known petroleum deposits. The tar sands contain a viscous hydrocarbon material, commonly referred to as bitumen, in an amount which ranges from about 5 to about 20 percent by weight. Bitumen is usually immobile at typical reservoir temperatures. For example, in the Cold Lake region of Alberta, at a typical reservoir temperatures of about 55° F., bitumen is immobile with a viscosity exceeding several thousand poises. However, at higher temperatures, such as temperatures exceeding 200° F., the bitumen generally becomes mobile with a viscosity of less than 345 centipoises.

Since most tar sand deposits are too deep to be mined economically, a serious need exists for an in situ recovery process wherein the bitumen is separated from the sand in the formation and produced through a well drilled into the deposit. Two basic technical requirements must be met by any in situ recovery process: (1) the viscosity of the bitumen must be sufficiently reduced so that the bitumen will flow to a production well; and (2) a sufficient driving force must be applied to the mobilized bitumen to induce production. Among the various methods for in situ recovery of bitumen from tar sands, processes which involve the injection of steam are generally regarded as most economical and efficient. Steam can be utilized to heat and fluidize the immobile bitumen and, in some cases, to drive the mobilized bitumen towards production means. Indeed, a majority of the processes currently employed utilize the injection of steam in one form or another.

Several steam injection processes have been suggested to heat the bitumen. One general method for recovering viscous hydrocarbons is by using "steam stimulation" techniques, the most common being the "huff and puff" process. In the process, steam is injected into a formation by means of a well and the well is shut-in to permit the steam to heat the bitumen, thereby reducing its viscosity. Subsequently, all formation fluids, including mobilized bitumen, water and steam, are produced from the well using accumulated reservoir pressure as the driving force for production. Initially, sufficient pressure may be available in the vicinity of the wellbore to lift fluids to the surface; as the pressure falls, artificial lifting methods are normally employed. Production is terminated when no longer economical and steam is injected again. This cycle may take place many times until oil production is no longer economical.

In the huff-and-puff method the highest pressures and temperatures exist in the vicinity of the well immediately following the injection phase. Normally this pressure and temperature will correspond to the properties of the steam which was employed. Before oil can be moved from the remote parts of the reservoir to the well, the pressure in the near well region must fall so it is lower than the distant reservoir pressure. During this initial depressuring phase, the near wellbore reservoir material cools down as water flashes into steam. The first production from the well thus tends to be steam and this tends to be followed by hot water. Eventually the pressure is low enough and oil can move to the wellbore. In the initial production phase, much of the heat which was put into the reservoir with the steam is simply removed again as steam and hot water. A major inefficiency of the huff-and-puff process is that this heat must be supplied during each cycle and as the available oil becomes more remote from the well, this cyclic wasted heat quantity increases.

The principal drawbacks of the "huff and puff" process, therefore, are: (1) production is not continuous, (2) the majority of the bitumen in the reservoir is never heated, thereby limiting recovery, and (3) the production cycle inherently removes most of the heating medium from the formation, and consequently much of the heating value of the injected steam is wasted.

A second general method for recovering viscous hydrocarbons is by using "thermal drive" processes. Typically, thermal drive processes employ an injection well and a production well, spaced apart from each other by some distance and extending into the heavy oil formation. In operation, a heated fluid (such as steam or hot water) is injected through the injection well. Typically entering the formation, the heated fluid convectively mixes with heavy oil and lowers the viscosity of the heavy oil, which is mobilized and driven by the heated fluid towards the production well. One advantage in using a thermal drive process is that higher recoveries may be obtained. For example, it has been the general experience in California that higher thermal efficiencies are achieved with steam stimulation, but that only relatively low recoveries are obtained overall. With steam floods, the recovery is higher, although more heat is used per barrel of produced oil.

Unfortunately, the general experience of industry has been that conventional thermal drive processes are not commercially effective in recovering bitumen from tar sands. One basic problem is that there is a restricted fluid mobility due to the high viscosity hydrocarbons cooling as they move through the formation; these cooled hydrocarbons build up away from the injection well to create impermeable barriers to flow. Another serious problems is that often the driving force of the flowing heated fluid is lost upon breakthrough at the production well. Fluid breakthrough causes a loss of driving pressure and a marked drop in oil production. In addition, much of the heating value of the heated fluid is lost upon breakthrough.

Various steam stimulation and thermal drive methods have been proposed in the prior art. For example, U.S.

Pat. No. 2,881,838 to R. A. Morse et al discloses a method for recovering viscous hydrocarbons wherein a single well is drilled through the producing formation; steam is then injected via the well into the upper portion of the formation to mobilize the viscous hydrocarbons which flow by gravity drainage to the bottom of the well; these mobilized hydrocarbons are then pumped to the surface. Steam is injected at rates calculated to continuously expand a heating zone in the formation as the mobilized heavy oil flows to the bottom of the well and is produced, but at the same time at rates which avoid substantial steam bypassing. A major disadvantage with Morse's process is that it contemplates only a radial process slowly growing from a vertical well. In such an operation, the heated surface during the initial stages is very small and only extremely low production rates are achieved.

In Morse, steam is introduced down the annulus of a well and liquids are produced up a central tubing. For this to be operable, it is necessary that at each point in the vertical well the steam be at a lower pressure than the pressure of the liquids in the inner tubing. If this is not the case, then heat will be transferred from the annulus through the tubing, condensing steam in the annulus, and boiling water in the tubing. This would be very wasteful. The Morse patent also suggests that a pump at the base of the well be able to overcome the hydrostatic head of liquid to the surface. In practice, it will also have to develop an additional pressure at the surface at least equal to the pressure of the injected steam, which may be uneconomical. The Morse patent also describes operation without a pump. If this were tried with the apparatus shown, then the pressure in the tubing would have to be less than the pressure in the annulus and excessive condensation of steam and flashing of water in the tubing would occur.

The Morse patent also does not recognize a problem which can arise from the evolution of non-condensable gas (natural gas) from the oil as it is heated. This non-condensable gas will mix with the steam and tend to accumulate near the interface. This will hinder the movement of the steam from the chamber to the interface where it is desired to condense it.

Yet another difficulty with the Morse process is that it recommends the use of a perforated and cemented casing for injection. A significant pressure drop would be required to cause injection of steam at practical rates from such a casing. This pressure difference would also be exerted at the bottom of the casing and would tend to prevent oil draining to the central production tubing.

U.S. Pat. No. 3,960,214 to Striegler et al discloses another approach which involves drilling a horizontal injection well and positioning several vertical production wells above and along the length of the injection well. A heated fluid is circulated through the horizontal well to contact the formation, mobilizing the bitumen which is then recovered through the vertical production wells. A problem sought to be addressed by this patent is that of providing a permeable, competent communication path between injection and production wells, thereby avoid the problems of cooled bitumen banking up to create impermeable barriers to flow. However, the mechanism of recovery is not clear and clearly does not depend on gravity drainage of heated oil.

Another example of a thermal drive method for continuously producing viscous mobilized viscous hydrocarbons is Canadian Pat. No. 1,028,943 to J. C. Allen. This patent proposes that prior to injecting steam into a formation, a non-condensable and non-oxidizing gas be injected to establish an initial gas saturation. Following this, a mixture of steam and non-condensable gas are injected. By utilizing this method, it is said that pressure communication between an injection well and a production well can be maintained and also premature pressure decline is avoided. Flow of oil from one well to the other is caused by lateral pressure differences; a gravity drainage process is clearly not involved.

Major problems still exist with each of these processes, in particular, and with thermal drive processes in general. One problem stems from the fact that the injected steam condenses and mixes with the mobilized bitumen as these fluids move through the formation. Any significant mixing of the mobilized heavy oil and condensed water results in a greatly reduced oil relative permeability. A second problem is that low steam injection pressures are often required to avoid the formation of fractures within a reservoir. However, at such pressures, it may not be possible to inject steam having enough heating value to economically heat the formation and mobilize the bitumen. A third problem is that as steam injection continues and the reservoir is heated, non-condensable gases contained in the formation will fractionate and accumulate in the reservoir. If this occurs to a significant extent, oil production can decline and stop due to a pressure buildup which counteracts oil flow.

Therefore, while the above methods are of interest, the technology has not generally been economically attractive for commercial development of tar sands. Substantial problems exist with each process of the prior art. Therefore, there is a continuing need for an improved thermal process for the effective recovery of viscous hydrocarbons from subterranean formations such as tar sand deposits.

SUMMARY OF THE INVENTION

In accordance with the present invention, an improved thermal recovery process is provided to alleviate the above-mentioned disadvantages; the process continuously recovers viscous hydrocarbons by gravity drainage from a subterranean formation with heated fluid injection.

An injection well for injecting a heated fluid, preferably steam, and a production well for producing oil and condensate are drilled into the formation. In the preferred embodiment, the wells are located along the fracture trend of the formation. The wells are completed such that separate oil and water flowpaths in at least the near-wellbore region of the production well are ensured with appropriately throttled injection and production rates. Initially, the formation is preferably fractured by injecting the heated fluid via the injection well at higher than fracture pressure. Alternatively, a suitable fracturing fluid may be used to create a fracture.

Steam is injected via the injection well to heat the formation. Injectivity is high and, in the preferred embodiment, a highly permeable flowpath is immediately established due to the fracture between the wells. As the steam condenses and gives up its heat to the formation, the viscous hydrocarbons are mobilized and drain by gravity toward the production well. Mobilized viscous hydrocarbons are recovered continuously through the production well at rates which, due to the construction of the wells, result in substantially separate oil and condensate flowpaths without excessive steam bypass. Oil relative permeability is higher than with prior methods wherein mixed flow occurs to a substantial extent.

In carrying out this invention, the conditions are chosen so that a very large steam saturated volume known as a steam chamber is formed in the formation adjacent to the injection well. The injection well must be connected to this chamber and steam is injected continuously so as to maintain pressure. At the boundary of the chamber, steam condenses and heat is transferred by conduction into the cooler surrounding regions. The temperature of the oil adjacent to the chamber is increased and it drains downwards, along with the hot steam condensate. The oil is removed continuously at a point below the chamber. As the oil drains downwards, it flows substantially separate from the steam and preferably separate from the condensate. This allows the relative permeability for the movement of oil to be maintained at a high value.

Various well configurations may be utilized to accomplish the method of the present invention. The following features are common to all configurations: (a) a production well is utilized which is "extended" through the tar sand formation, either as a horizontal well or by creating a fracture (or a combination of the two); (b) "thermal communication" between the injection and production wells is established before commencing production of oil; and (c) the injection and production wells are completed such that substantially separate oil/steam (and preferably oil/condensate) flowpaths can be maintained. The expression "separate flowpaths" is taken to mean flow without substantial mixing of the fluids, although some mixing will occur at fluid interfaces. The expression "thermal communication" is intended to mean that a relatively high permeability path at temperatures greater than normal reservoir temperatures is established from the injection well to the production well so that liquid heated by injected steam can drain continuously to the production well. In some cases condensate from injected steam may also flow to the production well. A predetermined saturation of mobilized heavy oil buildup is promoted and maintained adjacent to the lower portion of the production well, thereby providing increased oil relative permeability. The production well may be "extended" by drilling a horizontal well through the formation (either a deviated well or by drilling from a shaft or tunnel), or by forming a vertical fracture out into the formation from the production well. Also, any produced non-condensable gas is preferably purged from the steam chamber to the production well, i.e., some steam is allowed to move from the production well to keep the non-condensable gases flushed from the steam chamber.

In one embodiment, two nearly horizontal wells, one located directly above the other, are drilled into a formation and completed along a fracture trend. The upper well is used to inject steam and remove water and condensate, while the lower well is used to produce mobilized viscous oil. Production of oil is regulated so that separate oil and water flowpaths are maintained and excessive steam bypass is avoided. Preferably, any non-condensable gas which fractionates during steam injection is purged by means of a well connection to the upper part of the steam chamber. Such a connection may be a completely separate well or a connection to the annulus of that portion of the production well which is vertical. Production is regulated to prevent excessive steam bypass.

In another embodiment, two vertical wells are drilled through the formation and spaced from each other along the fracture trend of the formation. Each well is completed with weir means at its lower end. The function of the weir means is to promote separate oil/steam/water flowpaths in the formation by ensuring a fluid buildup in the wellbore. Steam is initially injected into the formation by means of one well at a pressure calculated to fracture the formation; alternatively a conventional fracturing fluid may be used for this purpose. With continued steam injection, immobile viscous oil is heated by conduction and begins to flow as its viscosity lessens. The mobilized viscous oil drains by gravity to both wells under pressure, where it is produced at rates regulated so as to ensure fluid buildup in the wellbores and to avoid excessive steam bypass.

In yet another embodiment, a horizontal well is extended into and along the lower portion of the formation in the direction of the prevailing fracture trend. A vertical well is located a short distance above the horizontal well. Again, both wells are completed in such a manner as to promote separate oil-water flowpaths. Steam is injected by means of the vertical well, and heavy oil is produced by means of the horizontal well. Again, any non-condensable gases which fractionate are purged through the horizontal well.

For each well configuration briefly described above, the method of the present invention finds particular application where the viscous hydrocarbons have a density when initially mobilized (i.e., when heated to a temperature sufficient to flow in the formation) which is greater than the density of the hot aqueous condensate which may form such as hot water which condenses from the injected steam. It has been found that this is typically the case for many viscous hydrocarbon deposits.

The present process substantially reduces problems found with conventional thermal processes and provides a much more uniform sweep of the reservoir. Instead of the flow of steam being confined to certain favorable passages within the reservoir, a process is provided which allows the steam to pervade the entire reservoir region. By utilizing gravity to move the oil downwards, along with a steam chamber which expands continuously to replace the drained fluids, the reservoir volume can be contacted in a methodical manner. This yields a high recovery. The process can be operated at low pressure. Relatively high production rates are achieved by using an extended well system—either a horizontal production well or a fractured well system, or a combination. The problem of reduced oil relative permeability associated with injecting hot fluids into viscous hydrocarbon-containing formations is mitigated by promoting separate oil/water flowpaths. Further, steam injection rates and product recovery are facilitated by preferably injecting steam at pressures which are initially above the formation fracture pressure. By permitting fracturing to occur, better communication is immediately provided for flowing mobilized viscous hydrocarbons. In practicing the method, it is especially preferred to vent any non-condensable gases which may fractionate during steam injection. This promotes the efficient transport of the steam to the steam chamber/heavy oil interface.

DETAILED DESCRIPTION OF THE INVENTION

The method of the present invention provides for continuous steam injection and heavy oil production in an efficient and economical manner. All of the well configurations disclosed herein have several basic operating features in common. First, a relatively large steam chamber in the tar sand formation is promoted by utilizing an "extended" production well. The production well is "extended" by forming a horizontal length through the formation, or by fracturing the formation between the production and injection well, or by using a combination of these approaches. The term "steam chamber" means the volume of the reservoir which is saturated with injected steam and from which mobilized oil has drained. Fracturing facilitates the injection of steam and, moreover, immediately establishes a highly permeable flowpath for the flowing heavy oil. Thermal communication between the injection and production wells is quickly established thereby. While the fracture can be formed initially by using high steam pressure it is desirable to operate at low steam pressures once the process has been established. This increases thermal efficiency. Second, each well configuration is designed to promote separate flowpaths for steam and liquids, and preferably substantially separate steam, water and oil flowpaths, with carefully regulated production rates. As will be described below, this significantly enhances oil relative permeability, increasing oil recovery efficiency. Third, the production rates of water and heavy oil are closely controlled to provide optimum oil production without excessive steam bypass. In addition, it is especially preferred to vent any non-condensable gases which may accumulate in the reservoir during injection of steam and recovery of product.

Figure 1:
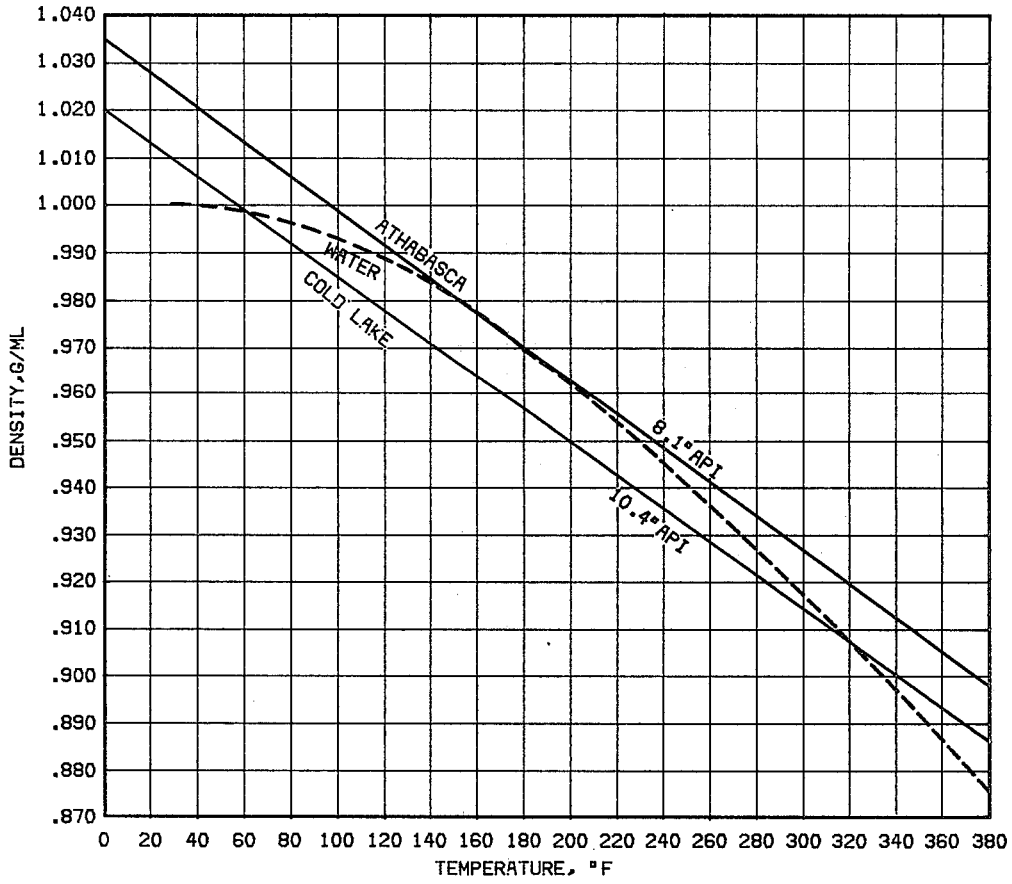
FIG. 1 is a plot of density versus temperature for Cold Lake and Athabasca heavy oil and water.

Finally, the method is especially suited for certain reservoir conditions; namely, the heavy oil when initially mobilized preferably should have a density which is greater than the density of hot aqueous condensate. It has been determined that several very important heavy oil deposits satisfy this requirement. This may best be illustrated by reference to FIG. 1. For example, if steam were injected at 380° F. it wil have a density of 0.007 g/ml. The oil when initially mobilized will be at a temperature of 380° or somewhat less. At these temperatures, Cold Lake crude oil will have a density of 0.886 g/ml or greater and Athabasca crude oil will have a density of 0.899 g/ml or more. Both values are greater than the density of the hot aqueous condensate, which would be about 0.875 g/ml. The condensate will thus tend to float on the oil.

Generally, in practicing the invention, the surface of the steam chamber must be very large since the gravity drainage process is very slow. By heating a large chamber area, the total flow of oil can be maintained at a practical value. "Chamber area" means the area of the steam chamber's outer surface boundary. For example, in the conduct of the invention, steam chambers as much as 1000 ft. long and 100 ft. high and 50 ft. in width (or larger) may be formed in a relatively short period of time, e.g. 10 to 100 days. Such a chamber can have a surface area measured in hundreds of thousands of square feet and, even with a viscous oil sands material such as that at Cold Lake, can produce total drainage rates measured in hundreds of barrels per day. In practicing this invention, the injection and production wells are designed such that a steam chamber having a surface area greater than 30,000 square feet can be formed within about 365 days and preferably within about 180 days or less; the formation of a chamber having a surface area of 50,000 square feet or more within about 365 days (preferably within about 180 days or less) is especially preferred.

The use of a simple vertical well with heat conducted radially would produce an initial steam chamber having an area of no more than a few hundred square feet and growing only very slowly, and would not be suitable for the practice of this invention. For the process described herein to be practical, it is necessary to develop steam chambers having very large surface areas relatively quickly. In the preferred embodiment of this invention, this is accomplished by developing a vertical fracture between the injection well and the production well and injecting steam into this fracture. The initial resulting steam chamber is thus very narrow in width but has considerable vertical and horizontal dimensions. This fractured chamber may be formed by initially employing steam pressure above the fracture pressure or by hydraulically fracturing the reservoir and propping it using appropriate proppants. Once the process has proceeded and substantial steam saturation has been achieved surrounding the original fracture, the fracture itself becomes less important since thermal communication in the form of a steam saturated volume has been established. At this stage, if the fracture was initially formed by using very high pressure steam, the pressure can be reduced and the process continued using steam at subfracturing pressure.

It is important to note that the pressure needed to form the fracture initially need not necessarily be maintained throughout the life of the well. Thus, for example, it is possible to initially operate the injection well at pressures greater than that needed to fracture the ground, but once a narrow steam chamber and mobile zone has been found to allow the pressure to fall and to operate at sub-fracturing pressures. Operation at very high pressures, and consequently high temperatures, in many cases would be wasteful of heat; less steam would be used to heat the reservoir to the lower temperatures corresponding to lower pressures.

Before discussing the method in detail with reference to the various well configurations depicted by FIGS. 2–6, the importance of promoting separate oil/water flowpaths should be emphasized. In prior art processes, much of the steam injected condenses and mixes with the mobilized oil as these fluids flow towards the production means. Because the oil and water mix, the oil relative permeability is significantly reduced. Permeability is the measure of the ease with which a fluid flows through the pore spaces of a formation. With high permeability, fluids will flow easily through the formation, while with low permeability, fluids will not move very readily. Permeability is an important economic indicator because it is one of the primary factors governing the rate at which oil and gas will move to the wellbore. The term relative permeability is utilized when a formation is saturated with more than one fluid, and is used to express the permeability of the formation to each fluid individually. Anything that would tend to decrease the relative permeability of a formation to the flow of oil is to be avoided. The magnitude of the reduction in oil relative permeability as between mixed oil/water flow and separate flow is illustrated by the following Table I:

TABLE I

Relative Permeabilities - Mixed Versus Separate Oil/Water Flow

| Water/Oil Ratio | Oil Relative Permeability | |
|---|---|---|
| | Separate | Mixed |
| 0 | 1.0 | 1.0 |
| 1 | 0.36 | 0.10 |
| 2 | 0.20 | 0.04 |
| 3 | 0.23 | 0.02 |

Table I indicates that water flowing with the mobilized heavy oil causes some reduction in oil relative permeability during flow in substantially separate flow paths, but that with mixed flow the reduction is vastly greater. This clearly illustrates the importance of promoting separate paths for the flow of the steam into the expanding steam chamber, the condensate and the mobilized heavy oil to the production means.

It should be noted that the use of the expression "substantially separate" is not meant to imply that mixing will not occur; on the contrary, at the water/oil interface there will certainly be mixing. However, by practicing the method disclosed herein, the majority of mobilized oil will flow separately from the steam and preferably from the aqueous steam condensate.

Figure 2:
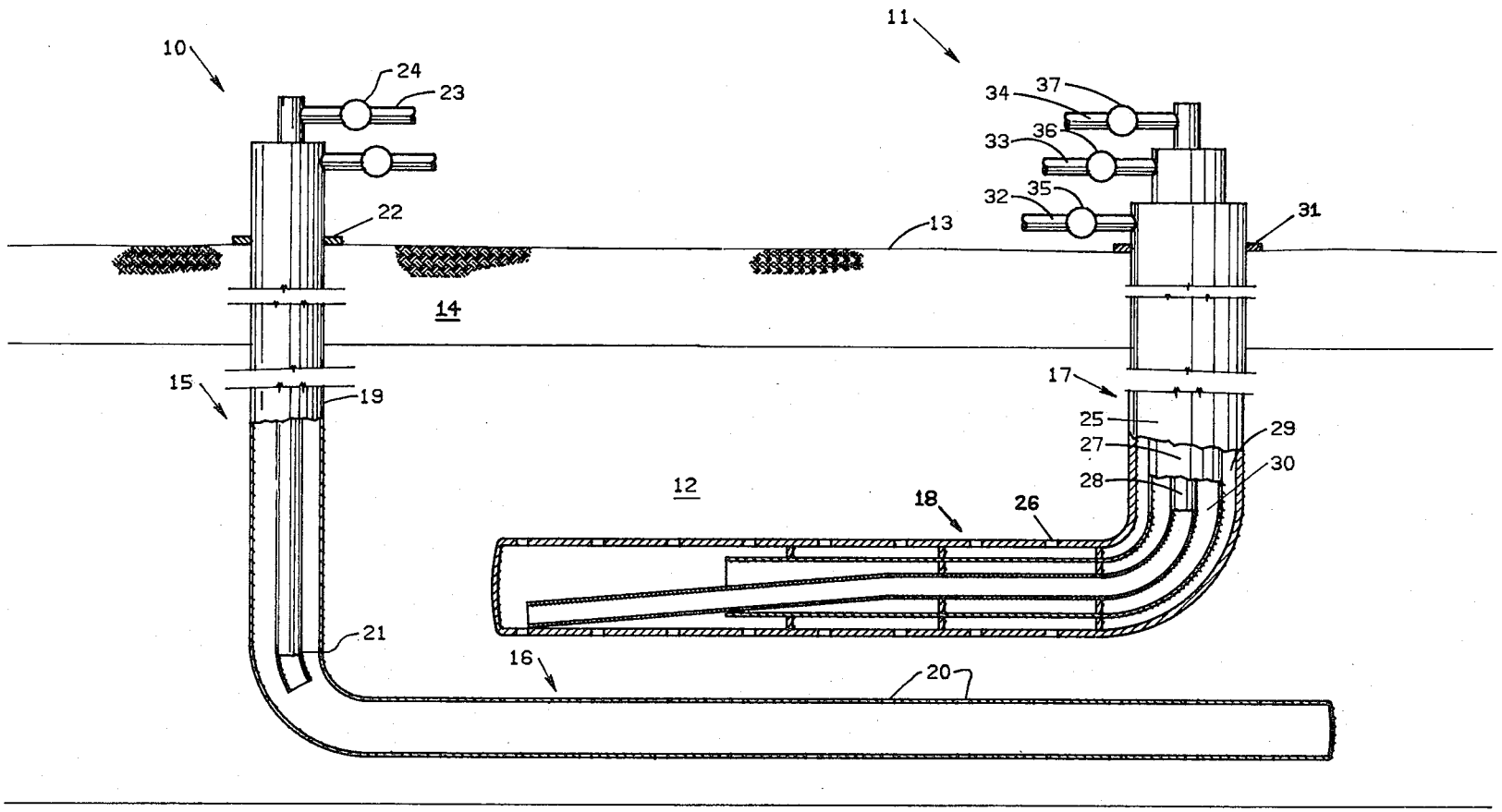
FIG. 2 is schematic vertical cross-section of a well configuration suitable for practicing Applicant's invention.

Referring now to FIG. 2, one embodiment of a well configuration utilized in practicing the present invention is schematically depicted. A first wellbore 10 and a second wellbore 11 are drilled to penetrate tar sand formation 12 disposed below the earth's surface 13 and beneath an overburden 14. The wells 10 and 11 are located so that they are in line with the fracture trend of the formation 12; these wells also "point" towards each other which has been discovered to facilitate purging of fractionated noncondensible gases, although the invention could be practiced with these wells pointing in the same horizontal direction. The wellbore 10 has a substantially vertically section 15 and a substantially horizontal section 16 extending through the tar sand formation 12. Likewise, the wellbore 11 has a substantially vertical section 17 and substantially horizontal section 18, approximately paralleling the first well. Each well is fitted with a continuous casing or liner having perforations or preferably slots over a substantial distance along the horizontal section. In practicing the present invention the wellbore 11 when completed is utilized as a steam injection well while the well 10 is utilized to produce the heavy oil.

Production well 10 includes casing 19 having a number of perforations 20 or, preferably, slots located over a substantial distance of horizontal portion 16. It is preferred to have the slotted portion of the horizontal production well extend up the vertical section nearly to a point somewhat above the horizontal section. This will permit venting of the steam from the upper slots in order to remove non-condensable gas from the steam chamber. A production tubing string 21 is disposed inside casing 19. The embodiment of FIG. 2 shows the production tubing 21 extending approximately to the base of the steam injection well. This prevents the liquid level being drawn below that point, i.e. this ensures that liquids fill the horizontal portion of the well. Centralizers are installed at various intervals in the annular space between tubing string 21 and casing 19; these centralizers are not continuous and do not block fluid flow in the annular space. Tubing string 21 passes through a wellhead 22 and communicates with a conventional production conduit 23 having a conventional flow control valve 24.

Injection well 11 includes casing 25 having perforations 26 along the horizontal section 18 which are in communication with the tar sand deposit 12. It may also be desirable to have the perforations extend up the vertical section nearly to the top of the injection well. This will allow this section to be used for the injection of some of the steam and allow easier entrance of the aqueous condensate to the horizontal section. As mentioned, having the two horizontal wells in opposing directions allows non-condensable gases to be swept to the production well more easily. Dual concentric tubing strings 27 and 28 are disposed inside the casing 25. The inner tubing string 28 is disposed within the surrounding larger diameter outer tubing 27. Conduit 25, 27 and 28 cooperate to define annular spaces 29 and 20. As with production well 10, centralizers are installed at various intervals in annular spaces 29 and 30 to maintain the annular relationship of the tubing strings and casing. The concentric conduits 25, 27 and 28 pass through a wellhead 31 and communicate with the usual production conduits 32–34 having the usual flow control valve 35–37.

The horizontal sections of both wells 10 and 11 can be inclined slightly downward. The techniques for drilling horizontally deviated wellbores are well known and, therefore, will not be discussed in detail herein. Likewise, the mechanics of completing a well are generally well known in the art; further details may be found in U.S. Pat. No. 4,116,275 to Butler, et al.

After completing production well 10 and injection well 11, the method of the present invention is accomplished as follows. With valve 24 of production well 10 closed, steam is injected via conduit 32 at pressures which exceed the fracture pressure of formation 12. For example, where the fracture pressure of formation 12 is 1200 psig, steam is introduced at 1300 psig at a saturation temperature of 580° F. A vertical fracture is formed in tar sand deposit 12 extending above and below each well. The light steam tends to rise in the fracture and into the formation where it condenses and gives up its heat to the deposit 12. As the steam condenses and drains downward to the injection well 11, heat is transferred by conduction to the deposit 12 and the heavy oil within it is heated. The heating of the heavy oil reduces it viscosity and allows it to drain by gravity downward towards the production well 10; the oil flows below the water flowing to the upper well 11. After the drainage process has begun and a steam chamber has formed, the steam injection rate is reduced and the steam chamber pressure is allowed to fall to the desired operating value. Typically, this will be in the range 100–500 psig depending upon the characteristics of the reservoir. With the equipment shown, sufficient pressure must be maintained to lift the produced fluid to the surface. This required pressure will be less than might be expected, however, because much of the volume of the wellbore will be full of steam which is formed by the flashing of water in the produced fluids. For example, a pressure difference of the order of 200 psi is sufficient to lift the fluid over 1000 feet. In general, higher pressures will give faster production rates but will require more heat per barrel of produced oil.

Figure 3:
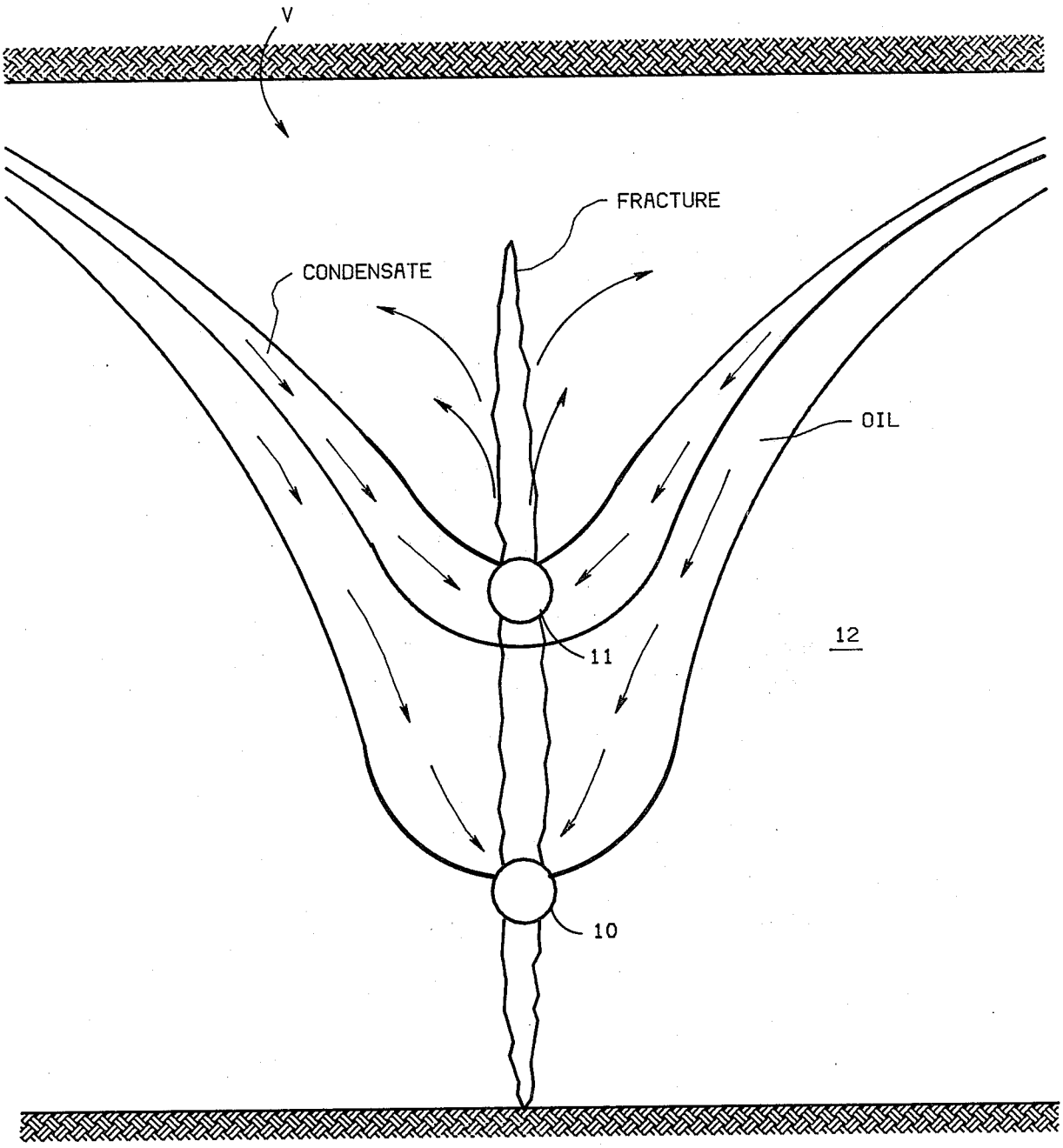
FIG. 3 is a schematic end view in section of the well configuration of FIG. 1.

A better perspective of the process may be gained by reference to FIG. 3, which illustrates operation of the process after a portion of the heavy oil in place has been recovered. As can be seen, the vertical fracture travels along the axis of both wells 10 and 11. A certain volume V of deposit 12 has been heated and the heavy oil therein has drained to production well 11. Aqueous condensate and oil drain by substantially separate flowpaths towards the wells due to the particular configuration of the wells and with appropriately throttled production rates. Condensate is recovered via well 11 while oil is recovered via well 10. The production rate of oil is regulated so that injected steam does not excessively bypass into well 10 and so that mixing of oil and water is minimized at least in the near-wellbore region of the formation. As a practical matter, this means that the flow of oil into any given portion of well 10 will be low; however, due to the long horizontal portion of well 10, overall production rates will be relatively good. Moreover, the efficiency of oil recovery will be very good, since substantially separate oil and condensate flowpaths are maintained during production. Expressed differently, this invention results in a relatively high oil saturation in the reservoir adjacent to the horizontal portion of the production well, and a relatively low water and steam saturation in the same region. This is different from conventional thermal drive processes wherein the primary heat transfer mechanism is forced convection, e.g. requiring that steam mix with oil. Thus, oil saturations may be maintained as high as $S_o$ (naturally occurring oil saturation) or higher and water saturations may be as low as $S_w$ (naturally occurring water saturation) or lower.

The heating value of the steam is fully utilized. Moreover, waste heat is more conveniently recovered from the hot condensate.

As mentioned, the present invention finds particular application where the heavy oil or bitumen has a greater specific gravity than that of hot water; this relationship is unlike that with many other crude oils. Thus, movement of oil and condensate through the formation towards the lower production well is promoted without substantially mixing with steam, and preferably with each other. Hence, an excessive reduction in oil relative permeability is avoided. Drainage of the mobilized heavy oil into production well 10 is facilitated initially by the presence of the fracture which passes through the wells. In the production well 10, oil is collected in the production tubing string 21 at the lowest point and flows to the surface driven by the prevailing reservoir pressure which is close to the steam pressure.

It is desirable to throttle the flow of oil by means of valve 24 at the surface so as to prevent water from entering into the production well 10. This valve may be controlled as to maintain the oil production temperature measured at the bottom of the well at a fixed level below the temperature of the steam. As steam injection continues, a certain amount of non-condensable gas will build up in the formation and which is preferably vented via the upper portion of well 10.

At the same time that oil is produced from well 10, aqueous condensate is flowing back to the injection well 11. Removal of condensate from well 11 is controlled by throttling the flow using valve 37 so as to maintain a small pool of water at the bottom of the injection well which prevents direct steam bypassing. Alternatively, a simple steam trap could be installed at the bottom of tubing string 28. This would prevent condensate from flowing upwards but would close if steam began to bypass. Also, a gas or other thermal insulating means may be introduced into annular space 29 to reduce heat transfer between the injected steam and the produced condensate.

Equation 1 may be derived for estimating the productivity (Q) of a well system of this type:

$$Q = 0.0264\, L \sqrt{\frac{\phi S_o \alpha K H}{m \nu_s}} \tag{1}$$

L Length of well in feet
$\Phi$ Fractional porosity of reservoir
$S_o$ Fractional Oil Saturation
$\alpha$ Thermal diffusivity of reservoir $ft^2$/day
K Permeability within oil saturated region md
H Height from top of reservoir to interface above the drainage well in feet
m A dimensionless number determined by the rate of change of viscosity of the crude with temperature. Normally it is between 3 and 4.
$\nu_s$ Kinematic viscosity of the crude at steam temperature in centistokes.
Q Oil drainage rate in B/D.

Using Equation 1, it is estimated that productivity would be about 0.2 to 1.0 barrel per day of heavy oil per foot of reservoir. Thus, a double horizontal well system as depicted in FIG. 2 having a length of 1200 feet extending through the tar sand deposit 12 should produce 240 to 1200 barrels per day.

In operating the well configuration of FIG. 2, steam is continuously injected and heavy oil continuously produced such that substantially separate oil and water flowpaths exist in the reservoir, at least in the wellbore region near the production well. Moreover, because most of the waste heat from the wells arrives at a constant temperature in the hot water stream at conduit 34, it is possible to recover much of this relatively high grade heat.

Figure 4:
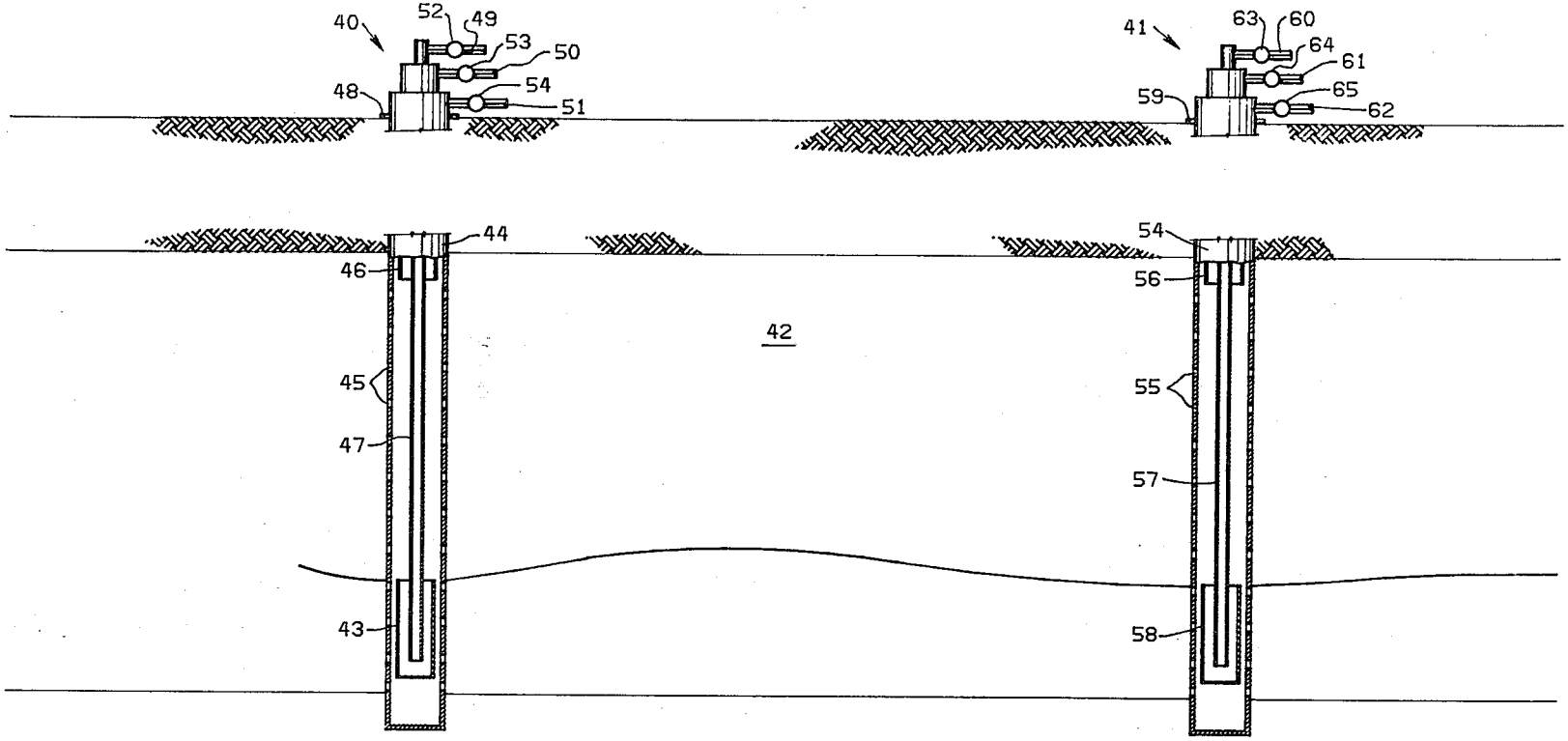
FIG. 4 is a schematic vertical cross-section of a second well configuration for practicing the invention.

FIG. 4 depicts another embodiment for performing the method of the present invention. Two wells 40 and 41 are drilled through tar sand formation 42 and spaced along the prevailing fracture trend. Both wells are completed in the same manner. Thus well 40 includes a continuous casing 44 having perforations or slots 45 (preferably slots) along the length of the casing 44 which traverses the tar sand deposit 42. An intermediate tubing string 46 is extended through casing 44 and ends near the top of formation 42. A production tubing string 47 is extended through both the intermediate tubing 46 and casing 44. The tubing string 47 extends to near the bottom of the formation 42 and is fitted with a cylindrical section of tubing 43 which is closed at the bottom, but open at the top. The tubing section 43 acts as a weir to ensure that a level of liquids builds up in the wellbore above the bottom of the production tube 47. This in turn has been found to promote separate oil and water flowpaths in at least the near-wellbore region. Again, centralizers may be utilized to maintain the various conduits in a space relationship; these centralizers should not significantly impede fluid flow. The concentric tubing strings and the casing pass through a wellhead 48 having the usual production conduits 49–51 and conventional flow control valves 52–54. The well 41 is completed in a similar manner and includes casing 54 having slots (preferably) or perforations 55, an intermediate tubing string 56, and inner tubing string 57 fitted with weir means 58. The concentric tubing strings and casing pass through a wellhead 59 fitted with conventional valves 63–65 and production conduits 60–62.

In practicing my method utilizing the well configuration depicted in FIG. 4, steam is injected via conduit 62 into the tar sand deposit 42 through the annulus formed by casing 54 and tubing 56. The injection pressure is preferably above the fracture pressure of the formation initially so as to create a vertical fracture running generally in the direction of the well 40. The length of the fracture may be as long as the distance between wells 40 and 41, but usually no longer than from 200 to 1000 feet. It is also possible to form the fracture by hydraulic fracturing and to prop the fracture open using conventional techniques. Initially, valves 63, 64 and 52–54 are closed. Once the fracture has formed, valve 52 may be opened to induce flow of condensate and oil along the fracture towards well 40. Steam is introduced continuously, flowing with relative ease along the fracture and with more difficulty at right angles to the fracture into the formation itself. Alternatively, steam can be injected into both wells simultaneously until thermal communication is established between wells. As the steam condenses and gives up its heat by conduction to the formation, the previously immobile bitumen begins to flow. The viscosity of the oil may change from 100,000 centipoise to less than 15 centipoise as it is heated. The density of the oil may change from 1.0 to 0.88, but is greater than the density of the hot, pressurized condensate which will have a density of about 0.85. Thus, the mobilized heavy oil begins to drain by gravity towards the well 40 along the fracture. Water formed by the condensation of the steam flows by gravity back towards the well 40 in a flowpath which is substantially different than the flow of the mobilized oil. Because the density of the mobilized oil is greater than the density of any condensate which forms, the condensate in essence "floats" on top of the oil.

Initially, the production rate of oil and condensate is maintained at a very low level by means of valve 52. This permits the steam to gradually heat the formation 42. As more oil is mobilized and flows downward in the formation and towards well 40 by gravity, the rate of production is gradually increased until an optimum rate is achieved. This rate will be that which gives substantially separate flowpaths, at least in the near-well region of well 40, and does not permit any significant steam bypass.

Figure 5:
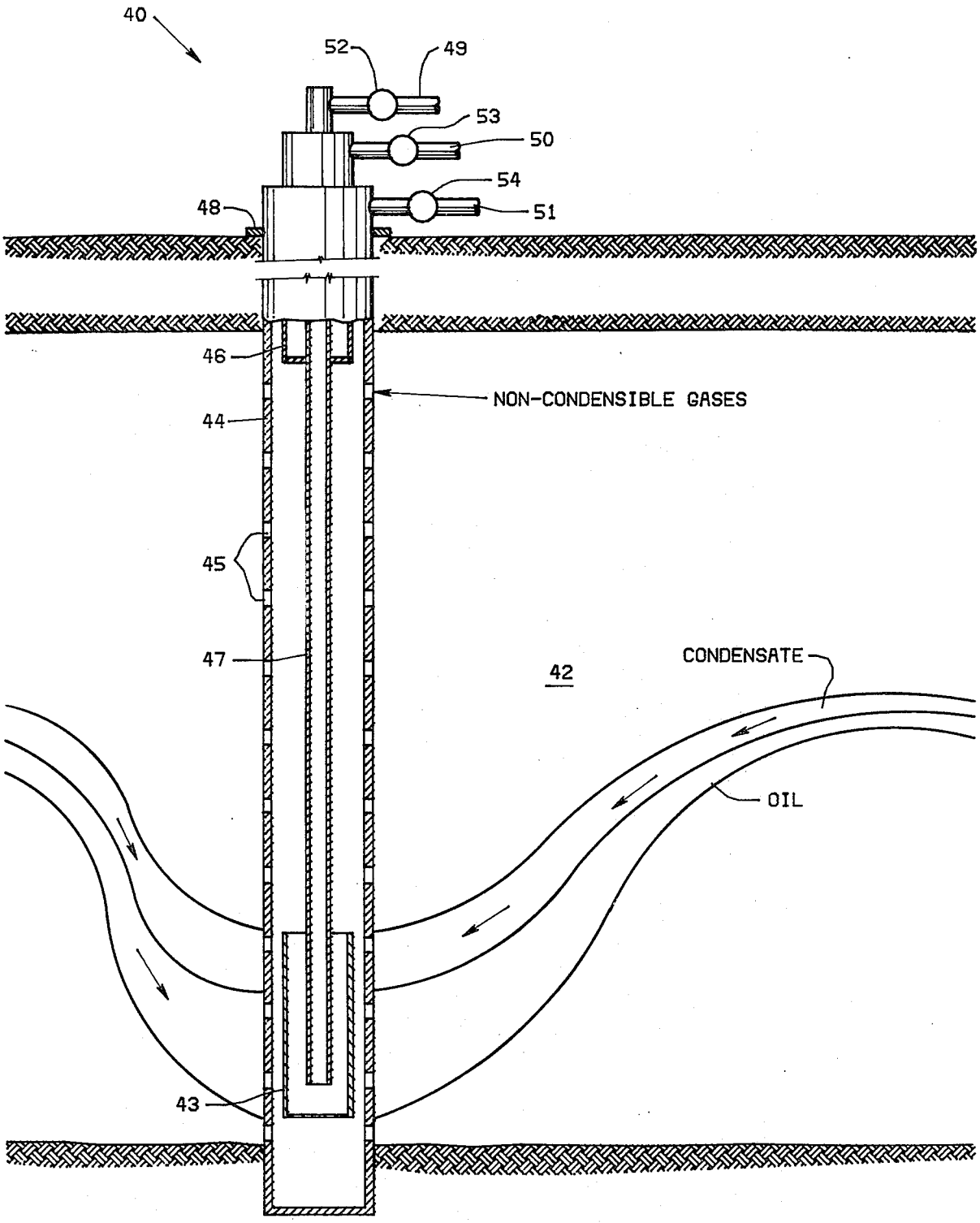
FIG. 5 is a schematic end view in section of the well configuration of FIG. 4.

FIG. 5 illustrates the process from another perspective after some time has passed. The production well 40 is shown in section and the shape of the expanded steamed zone may be seen. FIG. 5 also illustrates the operation of the weir means. In order to prevent mixing of the flowing oil and water layers as they near the bottom of the well 40, an internal weir 43 is connected to the bottom of the production tube 47. The weir insures that a level of liquids builds up in the wellbore above the bottom of the production tubing 47. The rate that water and oil are produced from the well is closely controlled by means of valve 52 so that the liquid level in the annulus between weir 43 and tubing string 47 is maintained below the top of the weir 43. By operating in the described manner, water drains back to the well through an essentially separate path from that used by the oil, especially in the near-wellbore region. Thus, a high oil relative permeability is promoted which enhances production. Steam is continuously injected and heavy oil is continuously produced at rates such that substantial steam bypass does not occur.

It is especially preferred that any non-condensable gases which collect in the steam zone by purged via well 40. Non-condensable gases such as methane, ethane or propane which are dissolved in the oil tend to be stripped by the steam and accumulate in the upper region of the deposit 42 which is saturated with steam. If this occurs to an excessive extent, the recovery process slows down and can become inoperable. In operation, with reference to FIG. 4, there is a net flow of steam and gas into the well 41. The bottom hole pressure of the well 40 is controlled at a level which is somewhat below the injection pressure of well 41. Non-condensable gases are purged at a rate which is calculated to maintain a relatively high steam chamber temperature and relatively high production rates, but at the same time so that excessive steam by-passing does not take place. Conduit 50 and valve 53 are provided for conventional purposes during production; for example, conduit 50 may be connected to a pressure gauge and with valve 53 open utilized in the measurement of bottom hole pressure.

Figure 6:
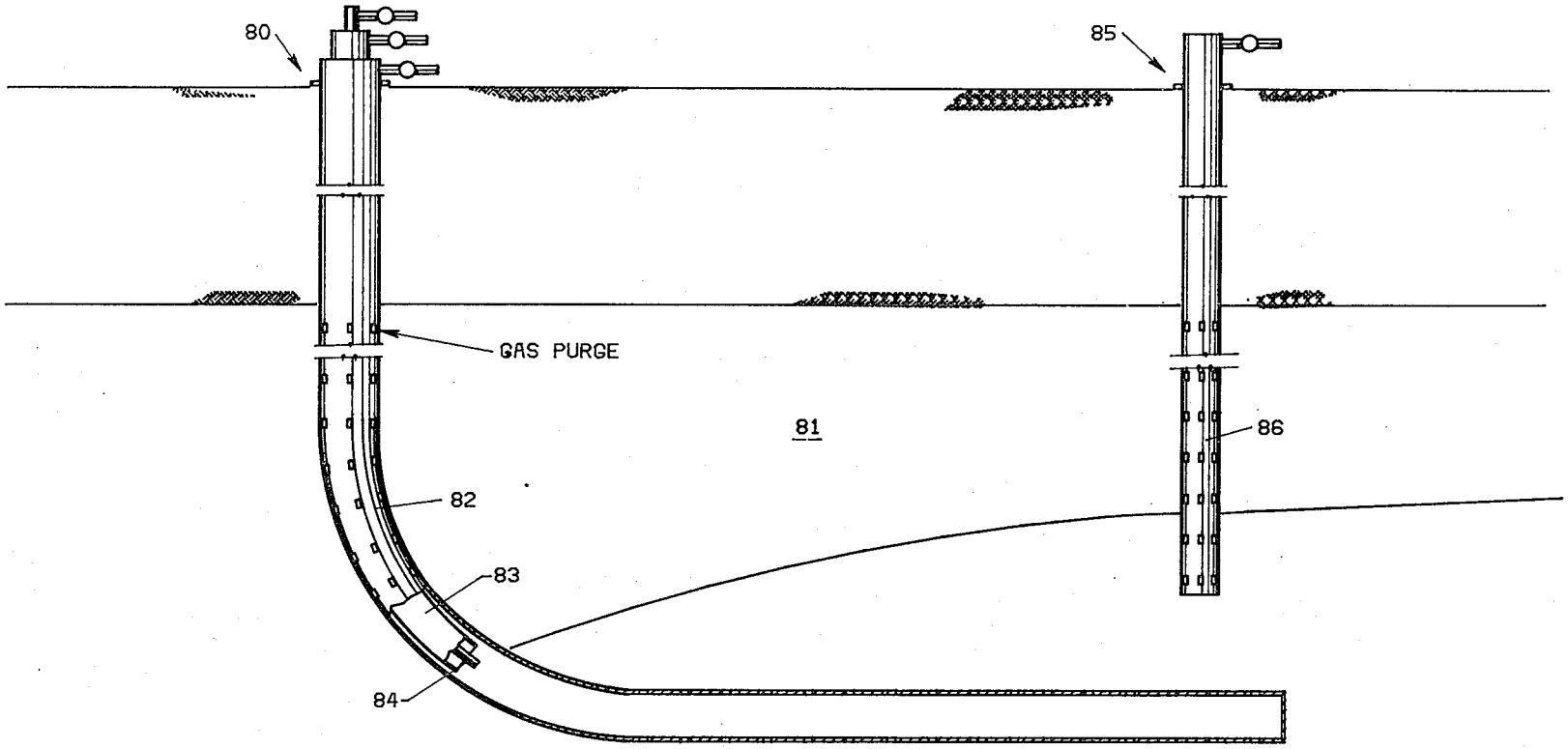
FIG. 6 is a schematic vertical cross section of a third well configuration for practicing the method of this invention.

Another embodiment is depicted by FIG. 6. In this well configuration, a horizontal well 80 is extended near the bottom of tar sand deposit 81. Well 80 is completed with a perforated or slotted casing 82 and concentric tubing strings 83 and 84, which terminate inside casing 82 at a level near the bottom of injection well 85, i.e. such that a relative long portion of slotted casing 82 extends into the formation free of the inner tubing strings. This manner of completion together with the appropriate production rate will ensure that the main horizontal part of well 80 remains full of liquid. This is important as with the other embodiments to promote substantially separate steam/liquid flowpaths, and preferably steam/water/oil flowpaths (in other words, a relatively high oil saturation adjacent to the horizontal portion), and hence higher oil relative permeability. The horizontal well is preferably drilled so that it extends along the fracture trend of the formation.

A vertical well 85 is drilled so that it extends near to the top of the horizontal portion of well 80. The bottom of well 85 will preferably extend to within about 5 to 10 feet from the top of well 80, but depending on the nature of the formation may be as far as 100 feet. Smaller distances will be used if it is desired to achieve thermal communication without fracture or if the direction of fractures is hard to predict. Well 85 is completed with a slotted liner 86 for steam injection.

In operation, steam is injected into the formation via well 85 above the fracture pressure of formation 81. A fracture forms approximately along the direction of the axis of well 80 to immediately provide, as before, a high permeability flowpath for steam, condensate and mobilized heavy oil. Mobilized heavy oil drain towards the nearly horizontal portion of well 80. Tubing strings 83 and 84 terminate at a distance which is calculated to maintain the main horizontal portion of well 80 full of liquid with throttled production. The described configuration promotes separate oil and water flowpaths thereby maintaining high oil relative permeability. In addition, any non-condensable gases which may accumulate in the deposit 81 are purged near the top of the reservoir via the outer annulus of well 80 via the slots in casing 82. These slots extend up the casing 82 to near the top of the reservoir.

Operation with a horizontal well, but without an initial fracture, may be desirable in cases where it is desired not to employ very high pressures. One example of where this may be important is in the drainage of oil from oil sands that are not very deeply buried and where fracturing may be uncontrollable. The technique can also be used where it is desired to drill the horizontal production well in a direction other than along a fracture trend; for example, it may be desired to drill it perpendicularly from the shore of a small lake which contains an oil sand reservoir beneath it. In such cases it is particularly desirable to have the injection well closer than usual to the horizontal well so that initial thermal communication may be established fairly rapidly by thermal conduction.

It may be noted that the well 80 is depicted with a triple tubing completion. In many cases, a dual tubing completion would suffice. Also, well 85 may be completed with a production tubing for production of liquids and may be a triple tubing completion so that insulating gas can be introduced into the annulus between the inner two tubing strings.

The term heated fluid, as used herein, is understood to mean a fluid having a temperature considerably higher, e.g. 150° F. to 1000° F., than the temperature of formation into which it is injected. It could be a heated gas or liquid such as steam or hot water and it could contain surfactants, solvents, oxygen, air, inert inorganic gases, and hydrocarbons gases. However, because of its high heat content per pound, steam is ideal for raising the temperature of a reservoir and is especially preferred for practicing this invention. Saturated steam at 350° F. contains 1192 btu per pound compared with water at 350° F. which has only 322 btu per pound or only about one-fourth as much as steam. The big difference in heat content between the liquid and the steam phases is the latent heat or heat of evaporation. Thus, the amount of heat that is released when steam condenses is very large. Because of this latent heat, oil reservoirs can be heated much more effectively by steam than by either hot liquids or non-condensable gases.

In all embodiments described above, several factors affected the volume of steam injected. Among these are the thickness of the hydrocarbon-containing formation, the viscosity of the oil, the porosity of the formation, amount of formation face exposed and the saturation level of the hydrocarbon, water in the formation and the fracture pressure. Generally, the total steam volume injected will vary between about 1 and about 5 barrels per barrel of oil produced. Moreover, the steam may be mixed with other fluids e.g. gases or liquids such as water, to increase its heating efficiency.

Steam is injected into the formation at pressures and rates sufficient to create the desired large steam chamber without substantially mixing with the mobilized heavy oil. Pressures are usually within the range of about 50 to about 1500 psig, preferably 50 to 600 psig, during the oil recovery phase. Of course, initial injection pressures will preferably be much higher if the formation is to be fractured with steam pressure; generally during oil recovery the steam pressure may be 50 to 600 psig. For operation without a pump, sufficient pressure must be employed to allow the produced fluids to flow to the surface and into the production line. Lower pressures can be employed if a pump such as a conventional sucker rod pump or, preferably, a chamber lift pump is provided at the bottom of the well.

In many cases the choice of pressure will be controlled by an economic balance between two important factors: (1) the high rates achieved using high pressures and hence high temperatures and, (2) the lower steam consumption resulting from lower temperatures. In many cases a pressure near to the minimum for operation without a pump will be particularly attractive. Once a sizeable steam chamber has been established it is desirable to operate at pressures significantly below the fracture pressure.

Generally, in most field applications the steam will be wet with a quality of approximately 65 to 90 percent, although dry or slightly dry or slightly superheated steam may be employed so as to reduce the quality of injected water. An important consideration in the choice of wet rather than dry steam is that it may be generated from relatively impure water using simple field equipment. The quantity of steam injected will vary depending on the conditions existing for a given reservoir.

Experimental

A laboratory scale drainage experiment to model the invention disclosed herein has been carried out. The experiment is intended to duplicate, in a dimensionally scaled manner, an oil production system in which a horizontal well is situated along the fracture trend at a height of about 10 feet above the base of a reservoir of thickness 100 feet. A steam injection well is located above the horizontal well and parallel to it. As has been described previously, a vertical fracture is formed between the two wells and steam is introduced into the upper one. The laboratory model is a two dimensional scaled model of a cross-section perpendicular to the two wells. Its shape is shown schematically in FIG. 7. The model reservoir was $4\frac{3}{8}''$ high and $11\frac{1}{2}''$ long. Thus the $4\frac{3}{8}''$ represents the vertical height (100 feet of the reservoir) and the $11\frac{1}{2}''$ half of the horizontal distance between the pair of wells being considered and an assumed identical adjacent pair. Thus the right hand edge of the model represents a vertical plane of symmetry between the pair of wells in the model and those in the adjacent pattern.

A wire mesh was placed at the left hand edge of the model to represent the fracture in the reservoir. The model was 1" thick and filled with glass beads of a diameter chosen to suit the dimensional scaling criterion discussed below (6 mm). A steam inlet was connected near the top of the model and a production outlet at the appropriate distance above the bottom. For the three dimensional field case, these inlet and outlet ports each represent part of the long horizontal injection and production wells respectively.

A mathematical analysis of the flows assuming a drainage mechanism similar to that discussed previously was carried out to produce a scaling criterion. It was found that a dimensionless number $B_2$ was the same for the model as for the field then the flows would be geometrically similar. The appropriate dimensionless number is:

$$B_2 = \frac{mkgH}{\phi S_o \alpha \nu_s} \quad (2)$$

$B_2$ is a dimensionless number which determines flow pattern.

m parameter in an equation approximating the change of oil viscosity with temperature:

$$\frac{\nu}{\nu_s} = \left(\frac{T_s - T_R}{T - T_R}\right)^m \quad (3)$$

for Cold Lake crude, m is 3–4.

$\nu$ Kinematic viscosity at temperature T.

$\nu_s$ Kinematic viscosity at steam temperature $T_s$.

$T_R$ Initial reservoir temperature.

k Effective permeability of reservoir in $ft^2$.

g Acceleration due to gravity ($ft/day^2$).

H Height of reservoir in feet.

$\Phi$ Reservoir porosity.

$S_o$ Recoverable saturation of oil.

$\alpha$ Thermal diffusivity ($ft^2/day$).

$\nu_s$ Kinematic viscosity of crude oil at steam temperature $T_s$($ft^2/day$).

The use of this criterion allows scaling from laboratory to field situations even where the operating temperatures, as a result of different steam pressures, are different.

If the parameters for the model are chosen so as to give the same value of $B_2$ as for the field then time is scaled according to the following criterion, $$T_2 = \frac{\alpha t}{mH^2}$$

where symbols are as before and $T_2$ is a dimensionless time number corresponding to t days.

If the dimensionless time number $T_2$ has a certain value for the model, then the fractional drainage at that time will correspond to that which would be expected at the time needed to give the same value of $T_2$ in the field case.

The use of this scaling approach will be apparent from the numerical data given in Table II. In this table two columns are shown; the first lists the parameters for the model and the second for a corresponding field case. Since these two sets of parameters both give identical values of $B_2$ (1619) the flow patterns in the model will be geometrically similar to those in the field.

TABLE II

| | Comparison of Model & Field Physical Data & Dimensions | |
|---|---|---|
| | Model | Field |
| m | 3.9 | 3.9 |
| kg $ft^3/day^2$ | 38100 (15000D) | 2.54 (1.0D) |
| H ft. | 0.34 | 100 |
| $\phi S_o$ | 0.4 | 0.21 |
| $\alpha$ $ft^2/day$ | 0.6 | 0.6 |
| $\nu s$ $ft^2$ | 131.9 (208° F.) | 4.87 (421° F.) (312 psia) |
| $B_2$ | 1619 | 1619 |
| $T_2$ | 1.29t | $1.54 \times 10^{-5}$t |

Ten minutes for the model is thus equivalent to $(10/60)(1.20/(1.54\times10^{-5})=14000$ hours in the field or 1.6 years.

In summary, it is possible to construct laboratory models for gravity drainage experiments which will give geometrically similar performance to that in the field provided that the permeability of the laboratory model is chosen so as to give equivalent values to the dimensionless number $B_2$.

Figure 7:
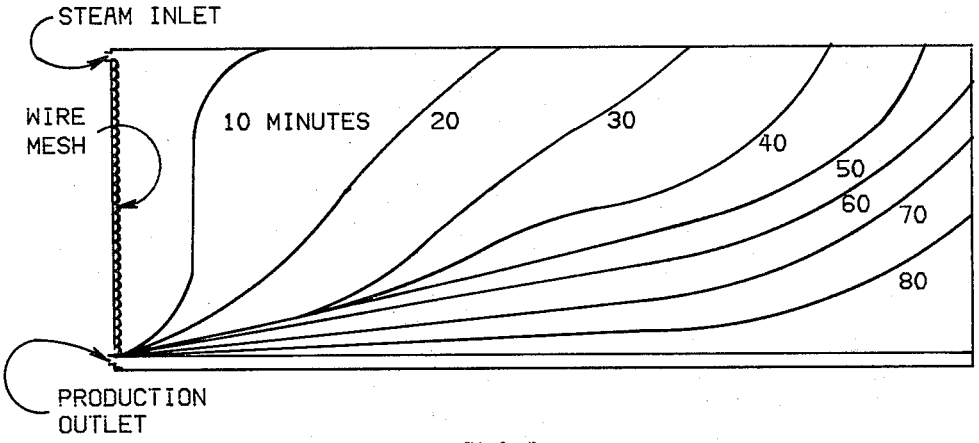
FIG. 7 is a schematic side view of a small scale model of the well configuration of FIGS. 2 and 3.
Figure 8:
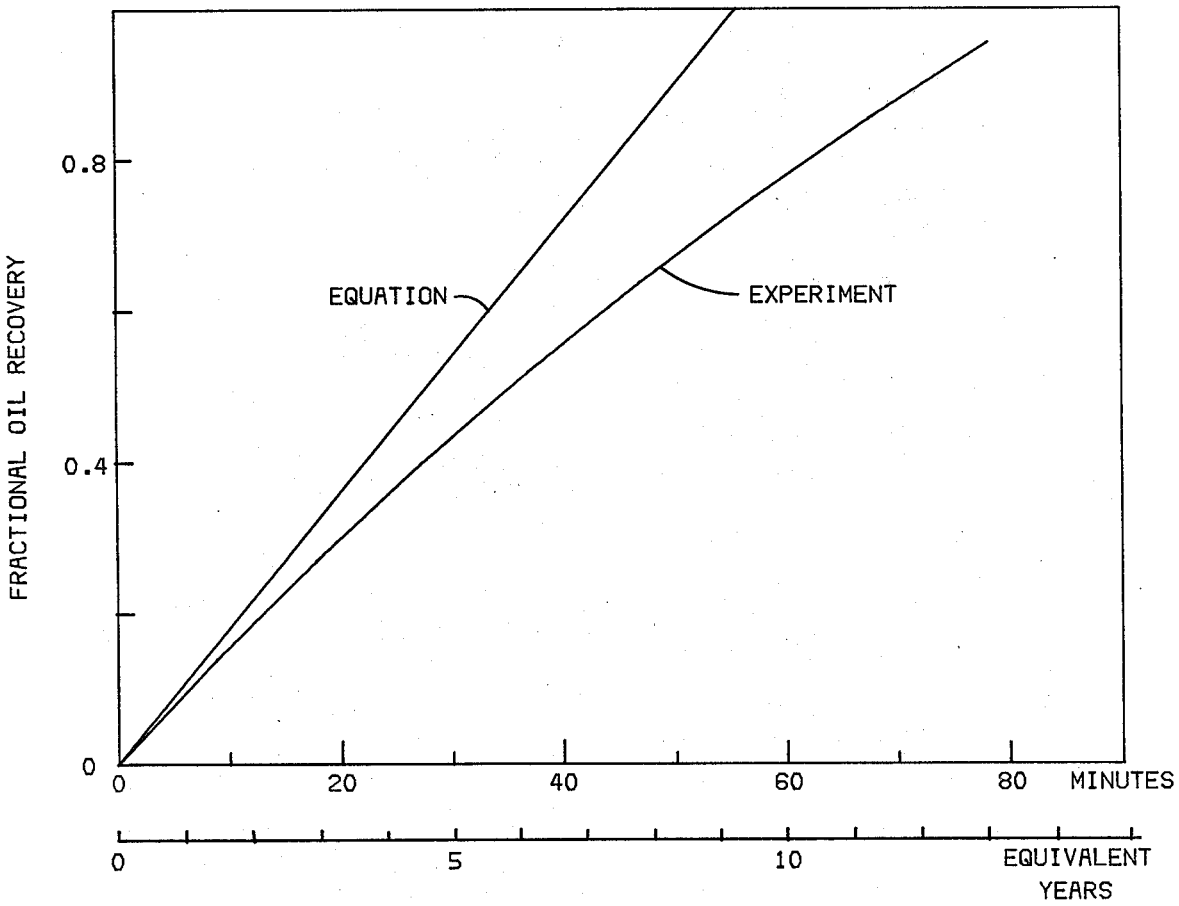
FIG. 8 is a plot of fractional oil recovery versus time.

The laboratory model shown in FIG. 7 was filled with Cold Lake crude oil by slowly flooding it through one of the ports. When it was completely full, it was cooled to room temperature. Steam was introduced into the steam inlet at atmospheric pressure. Condensate and oil ran from the production outlet. The course of the experiment could be followed visually since the two large surfaces of the model were made of transparent material. The position of the oil interface is shown at 10 minute intervals by the curved lines on FIG. 7. It will be noted that drainage was continuous and that it provided a systematic way of removing essentially all of the oil. The cumulative drainage of oil is shown plotted as a function of time in minutes in FIG. 8. Eighty percent of the oil drained in about one hour. It will be noted that there was a tendency for the rate to decrease as the experiment progressed which was due to the fact that the pressure head available to move the oil to the production well decreased as the reservoir became depleted. Also shown in FIG. 8 is the time in years which would be required to drain the geometrically similar field example of Table II. In ten years it is predicted that about 80% of the recoverable oil would be removed.

Also shown in FIG. 8 is a straight line which is the rate which would be predicted by the equation given previously. It will be noted that the rate from this equation is of the same order as the initial rate in the experiment, but that the equation does not predict the decline in the rate as the reservoir is depleted. It is however useful to estimate the initial rate and, if a reasonable allowance is made for the effect on depletion, it can also be used to estimate the overall course of the drainage process.

In the example shown, 80% of the ultimate recovery is predicted to occur in the field case in ten years. Thus, for a horizontal well system 1500 ft. long the average daily production can be predicted as follows:

| | | |
|---|---|---|
| $\phi S_o$ | = | 0.21 (recoverable) |
| H | = | 100 feet (90 ft. above well) |
| Well Spacing | = | $100 \times (11.5/4.375) \times 2 = 526$ ft. |
| Oil recovered in ten years | = | $0.21 \times 90 \times 526 \times 1500 \times 0.8$ |
| | = | $1.19 \times 10^7$ $ft^3$ |
| | = | 2.1 million barrels |
| Average daily production | = | 582 barrels |

The initial daily rate may be calculated from, $$Q = 0.0264\, L \sqrt{\frac{\phi S_o \alpha k H}{m \nu_s}}$$

$$= 0.0264 \times 1500 \sqrt{\frac{0.21 \times 0.6 \times 1000 \times 90}{3.9 \times 5.24}}$$

$$= 933\ B/D$$

Various modifications and alterations of this invention will become apparent to those skilled in the art without departing from the scope and spirit of this invention. It should be understood that this invention should not be unduly limited to the specific embodiment set forth herein.

What I claim is:

1. A process for mobilizing and recovering normally immobile oil from a tar sand deposit which is penetrated by first and second wells, said first well being used for producing oil and said second well being used for injecting a heated fluid, the process which comprises:

(a) completing said first and second wells so that oil, when mobilized, flows substantially separate from said heated fluid;

(b) extending said first well into said formation in a substantially horizontal direction to enable creation of a heated, permeable chamber in said formation between said first and second wells upon injection of said heated fluid;

(c) initially injecting said heated fluid into said second well at a high rate such that thermal communication is established between said first and second wells and such that said heated permeable chamber is created;

(d) continuing to inject said heated fluid at a reduced rate such that said normally immobile oil is heated substantially by conduction and drains downward by gravity to said first well without substantially mixing with said heated fluid, said heated fluid causing said heated permeable chamber to expand with continuous drainage of oil to said first well; and (e) recovering the mobilized oil via said first well.

2. The process of claim 1 wherein said heated fluid is steam.

3. The process of claim 1 wherein said normally immobile oil, when heated sufficiently to become mobilized, has a density greater than the steam condensate formed in said deposit.

4. A method for recovering oil from a tar sand deposit, said oil being essentially immobile at normal reservoir temperatures, comprising:

(a) penetrating said deposit with a first well for injecting a heated fluid;

(b) penetrating said deposit with a second well for producing fluids, and extending said second well into said formation in a substantially horizontal direction, said first and second wells being constructed and arranged so as to promote the growth of a heated fluid region in said deposit adjacent to both said first and second wells of greater than 30,000 $ft^2$ boundary surface area within about 365 days of initiating heated fluid injection;

(c) completing said second well so that a predetermined high saturation of oil is maintained adjacent to the lower portion of said second well during production;

(d) injecting heated fluid into said first well at a high rate calculated to produce said heated fluid region;

(e) continuing to inject steam at a reduced rate calculated to maintain said predetermined saturation and such that said normally immobile oil is heated by conduction and continuously drains downward by gravity to said second well substantially separate from said heated fluid; and (f) producing said oil through said second well.

5. A method for recovering normally immobile heavy oil by gravity drainage from a subterranean formation which comprises:

(a) penetrating said formation with a production well having a substantially horizontal portion extending a substantial distance through said formation;

(b) penetrating said formation with a substantially vertical injection well located approximately above said horizontal portion;

(c) completing and operating said production well such that during production the liquid level in said production well is maintained above said horizontal portion;

(d) initially injecting heated fluid into said injection well at a high rate such that thermal communication is established between said production well and said injection well, followed by the formation of a heated permeable region between said wells and surrounding said horizontal portion;

(e) continuing the injection of heated fluid at a reduced rate such that said heavy oil is heated primarily by conduction, becomes mobile and drains downward by gravity to said horizontal portion without substantial mixing with said heated fluid; and (f) continuously producing said mobilized heavy oil through said production well as said heated permeable region expands to incorporate an increasing surface area of said formation.

6. The method of claim 5 wherein said heated permeable region has a boundary surface area of 30,000 $ft^2$ within about 180 days of the initial injection of said heated fluid.

7. The method of claim 5 wherein said heated fluid is steam.

8. The method of claim 7 wherein aqueous condensate from the steam flows towards said production well substantially separate from said mobilized heavy oil.

9. The method of claim 5 wherein said heavy oil has an API gravity of about 13.5° or less.

10. The method of claim 5 further including injecting said heated fluid into said production well so as to assist in establishing thermal communication between said production and injection wells.

11. The method of claim 5 wherein said injection well extends from about 5 to about 200 feet from said horizontal portion.

12. The method of claim 5 further including locating said production wells substantially along the prevailing fracture trend of said formation and fracturing said formation prior to performing step (e).

13. The method of claim 12 wherein steam is used to fracture said formation.

14. The method of claim 12 wherein a hydraulic fracturing fluid is used to fracture said formation.

15. The method of claim 5 wherein the density of said oil, when heated to a temperature just sufficient to mobilize said oil, is greater than the density of the hot aqueous condensate formed from the injected steam.

16. A process for producing normally immobile bitumen from a tar sand deposit which comprises:

(a) penetrating said deposit with a first wellbore for injecting steam and a second wellbore for producing bitumen, said first and second wellbores lying along a fracture trend of said deposit;

(b) completing said first and second wellbores such that during the production of bitumen, a predetermined level of bitumen builds up in said second wellbore with throttled production, said level being calculated so as to assure that in the deposit mobilized bitumen flows substantially separate from the steam injected into said deposit;

(c) injecting steam into said first wellbore initially at fracture pressure or above to create a fracture between said wellbores and a steam chamber surrounding said fracture, (d) continuing to inject steam at a reduced rate to heat said bitumen thereby causing said steam chamber to gradually expand in said formation as said bitumen becomes heated by conduction, mobilizes, and flows downward by gravity towards said second wellbore substantially separate from any steam condensate;

(e) producing said bitumen at rates which establish said predetermined level of mobilized bitumen in said wellbore.

17. The process of claim 16 wherein non-condensable gases fractionate from said bitumen and said non-condensable gases are vented during oil production by means of said second wellbore.

18. The process of claim 16 wherein non-condensable gases fractionate from said bitumen and said non-condensable gases are vented by means of another well completed to near the top of the formation.

19. The process of claim 16 wherein said second wellbore is extended substantially horizontally through said deposit and said first wellbore extends substantially vertically into said deposit to a point near the horizontal portion of said second wellbore.

20. The method of claim 16 wherein a portion of said first and second wellbores extend substantially horizontally through said deposit in a substantially parallel relationship.

21. A process for producing normally immobile bitumen from a tar sand deposit which comprises:

(a) penetrating said deposit with a first wellbore for injecting steam and a second wellbore for producing bitumen, and extending a portion of said first and second wellbores substantially horizontally through said deposit in a substantially parallel relationship, said first and second wellbores lying along a fracture trend of said deposit;

(b) completing said first and second wellbores such that during the production of bitumen, a predetermined level of bitumen builds up in said second wellbore with throttled production, said level being calculated so as to assure that mobilized bitumen flows substantially separate from the steam injected into said deposit;

(c) injecting steam into said first wellbore initially at fracture pressure or above to create a fracture between said wellbores, and continuing to inject steam to heat said bitumen thereby causing bitumen to become mobilized and to flow by gravity towards said second wellbore along with any steam condensate;

(d) producing said bitumen at rates which establish said predetermined level of mobilized bitumen in said wellbore.

* * * * *